United States Patent [19]

Schulte et al.

[11] 4,291,509

[45] Sep. 29, 1981

[54] GUARD HOUSING AND LINER FOR BLADED CENTRIFUGAL BLASTING WHEELS

[75] Inventors: Harold F. Schulte, Mishawake; Raymond M. Leliaert; Robert D. Rohr, both of South Bend, all of Ind.

[73] Assignee: Wheelabrator-Frye Inc., Hampton, N.H.

[21] Appl. No.: 87,060

[22] Filed: Oct. 22, 1979

[51] Int. Cl.[3] ..... B24C 9/00

[52] U.S. Cl. ..... 51/432; 51/431

[58] Field of Search ..... 51/431, 432, 433, 434, 51/435, 268; 241/275

[56] References Cited

U.S. PATENT DOCUMENTS

| | | | |
|---|---|---|---|
| 2,341,559 | 2/1944 | Keefer | 51/432 |
| 3,319,383 | 5/1967 | Bowling | 51/431 |
| 3,744,190 | 7/1973 | DeGroot | 51/431 |
| 3,800,474 | 4/1974 | Sack | 51/431 |

FOREIGN PATENT DOCUMENTS

| | | | |
|---|---|---|---|
| 2437493 | 2/1976 | Fed. Rep. of Germany | 51/432 |

*Primary Examiner*—Gary L. Smith

*Attorney, Agent, or Firm*—McDougall, Hersh & Scott

[57] ABSTRACT

A guard housing and liner for bladed throwing wheels, in which the guard housing is in the form of a trapezoidal section dimensioned to enclose the bladed wheel and a cover which fits onto the upper end of the trapezoidal section for pivotal movement between open and closed position and for removal from said trapezoidal section, and a liner formed of a plurality of interfitting sections lining the interior walls of the guard housing.

12 Claims, 19 Drawing Figures

GUARD HOUSING AND LINER FOR BLADED CENTRIFUGAL BLASTING WHEELS

This invention relates to bladed wheels whereby particulate material, such as abrasive particles, are thrown by centrifugal force from the ends of the blades onto an object or surface to be cleaned, abraded or otherwise treated.

Airless centrifugal throwing wheels of the type described are marketed by Wheelabrator-Frye Inc. under the trade name WHEELABRATOR. Such wheels consist of a pair of spaced parallel side plates having a number of blades extending radially between the plates in equally circumferentially spaced apart relation with means removably securing the blades in position of use between the plates. Means are provided for driving the wheel in rotational movement at high speed about a central axis and for feeding particulate material onto the inner end portions of the blades whereby the particulate material is displaced centrifugally outwardly over the surfaces of the blades and projected at high velocity from the ends of the blades onto the surface to be treated. Means, such as an impeller, are provided in a central opening between the blades for feeding the particulate material onto the inner end portions of the blades, with a control cage in between for controlling the passage of the particulate material onto the ends of the blades thereby more accurately to define the blast pattern and direction of the particulate material thrown from the ends of the blades.

The rapidly moving wheel and blades present a hazard from the standpoint of injury upon contact with moving parts and the rare occasion when a part might let loose or break off and fly through the air as a projectile. Of even more constant danger are the stray particles which might be thrown by the wheel or ricochet off various surfaces for entry into the surrounding area. Thus, it is important to place a guard about the wheel for enclosure of the wheel entirely except for axial openings through which the particulate material is fed to the impeller and blades and for the area through which the particulate material is projected from the ends of the blades onto the surface to be treated, as controlled by the control cage.

It is an object of this invention to provide a guard housing for a centrifugal blasting wheel of the type described which is simple in construction and easy in assembly to enclose the wheel, which provides means for ready access to the wheel for repair or replacement of parts, such as the removal of the control cage and impeller to enable replacement of blades; which is sturdy in construction to provide the desired protection; and which includes a lining formed of assembled parts to take the impact and wear imposed by the abrasive particles travelling at high speed within the guard housing.

IN THE DRAWINGS

Figure 1:
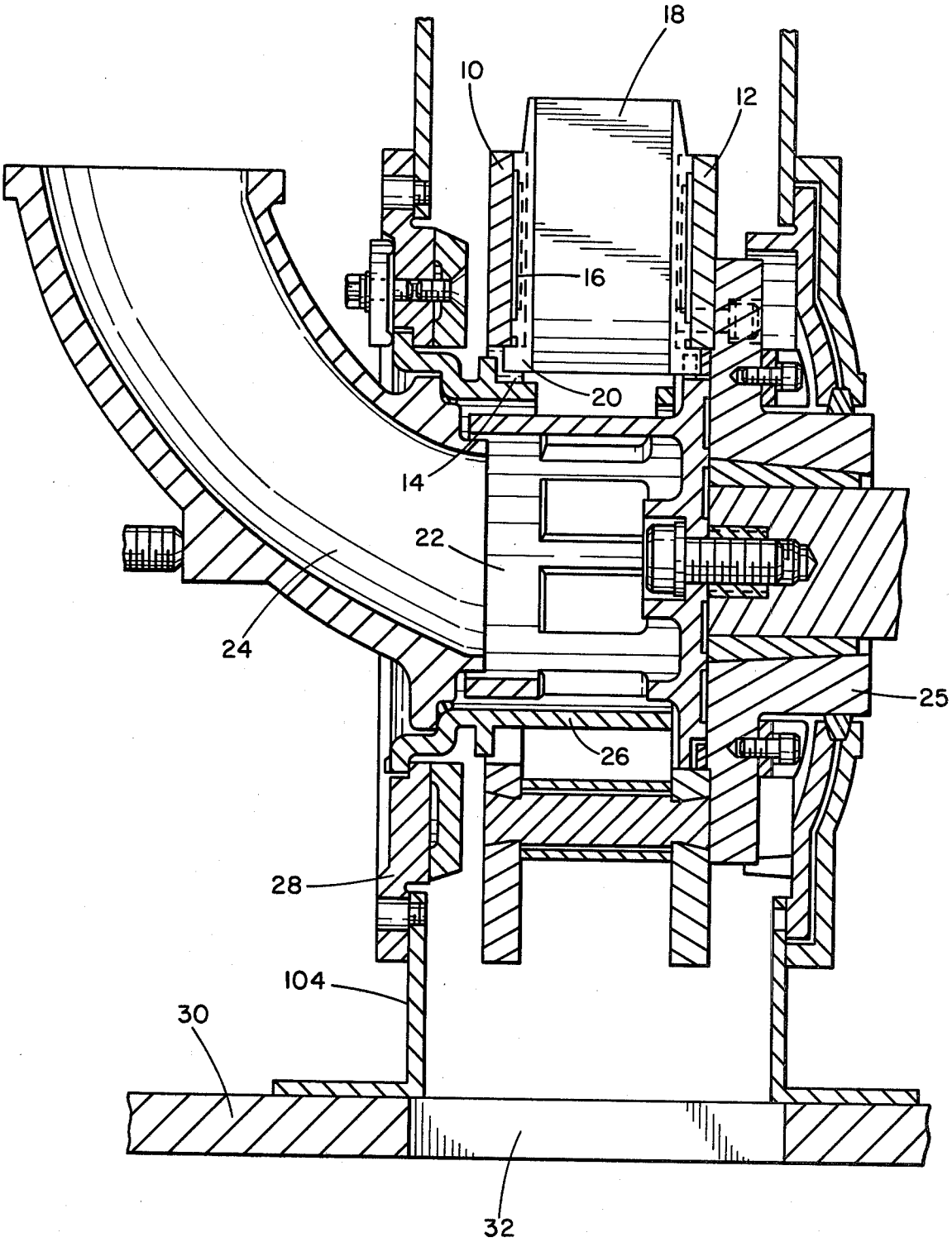
FIG. 1 is a sectional elevational view of the wheel assembly.

In our copending application Ser. No. 78,478 filed Sept. 24, 1979 and entitled "Bladed Centrifugal Blasting Wheel", description is made of a centrifugal blasting wheel shown in FIG. 1 of the drawings. Briefly described, the essential parts of the wheel include a pair of front and back plates 10 and 12 having a central opening 14. Each of the front and back plates are formed with equally circumferentially spaced apart, radially extending, crosswise aligned grooves 16 in their inner surfaces for receiving radially extending, rectangularly shaped blades 18 therebetween with means 20 releasably locking the blades between the plates.

An impeller 22 in the form of vaned cylindrical member is positioned within the axial opening 14 between the plates for displacement of particulate material fed from an inclined feed spout 24 having its exit end in axial alignment with the interior of the impeller 22. A control cage 26, in the form of a cylindrical member, is located in the axial opening between the outer periphery of the impeller 22 and the inner ends of the blades 18, with a slot in the cylindrical section of the control cage through which the particulate material passes from the impeller onto the ends of the blades, thereby to control the location of the feed which in turn controls the direction and pattern of the particulate material thrown from the ends of the blades.

Means are provided, such as a lined adapter plate 28, for supporting the control cage in position of use while enabling rotational adjustment of the control cage relative thereto for varying the location of the control slot correspondingly to control the direction and pattern of the blast of the particulate material thrown from the blades. The adapter plate is in turn fixed to a base plate 30 having an opening 32 in radial alignment with the bladed wheel for passage therethrough of the particulate material as it is thrown from the ends of the blades onto a surface to be treated underlying the opening 32.

The location of the guard housing relative to the wheel is indicated by the phantom lines in FIG. 1 as enclosing the wheel entirely except for the portions aligned with the central opening in the front plates through which the feed spout extends into the impeller and a central opening in the back plate through which the hub extends for engagement with the driving means and the opening 32 in the base plate aligned with the underside of the wheel through which the particulate material is projected for impact with the surface to be treated.

Figure 2:
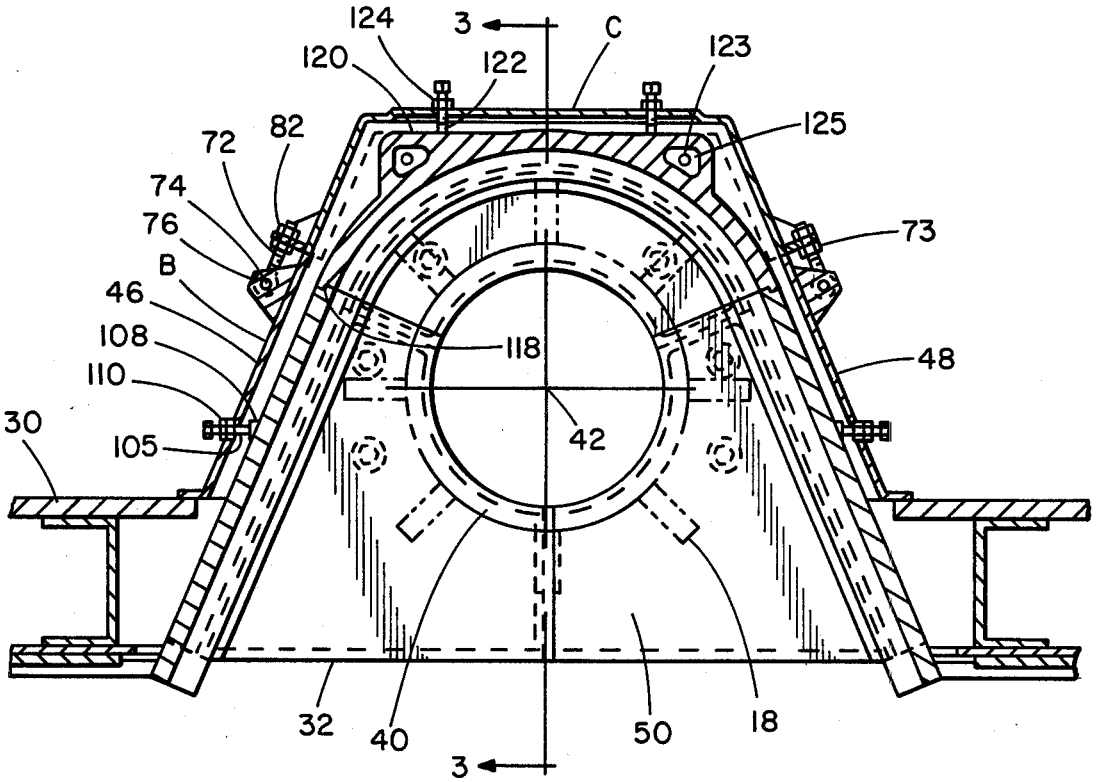
FIG. 2 is a sectional elevational view of the guard housing and lining embodying the features of this invention.
Figure 3:
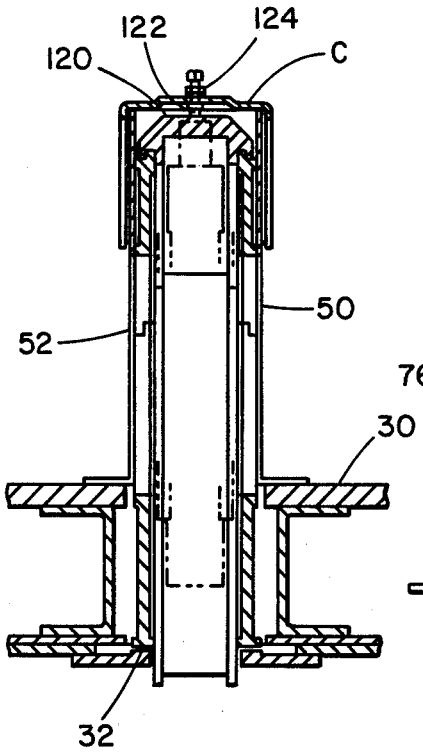
FIG. 3 is a sectional elevational view taken along the line 3—3 of FIG. 2.

The guard housing and lining will now be described in greater detail with reference to the assembly of the various parts of the guard housing and lining as shown in FIGS. 2 and 3 of the drawings. In FIG. 2, the wheel is indicated by the numeral 40 and the blades are indicated by the numeral 18. The wheel is mounted within the housing for rotational movement about an axis 42 with the blades 18 projecting through the opening in the base plate 30.

The guard housing is formed of two parts including a base portion B and a cover portion C with the cover portion hingedly connected onto the base portion to enable rocking movement of the cover between open and closed positions and for removal of the cover entirely from the base portion. The guard housing may be cast or formed as by stamping to the desired shape.

Figure 4:
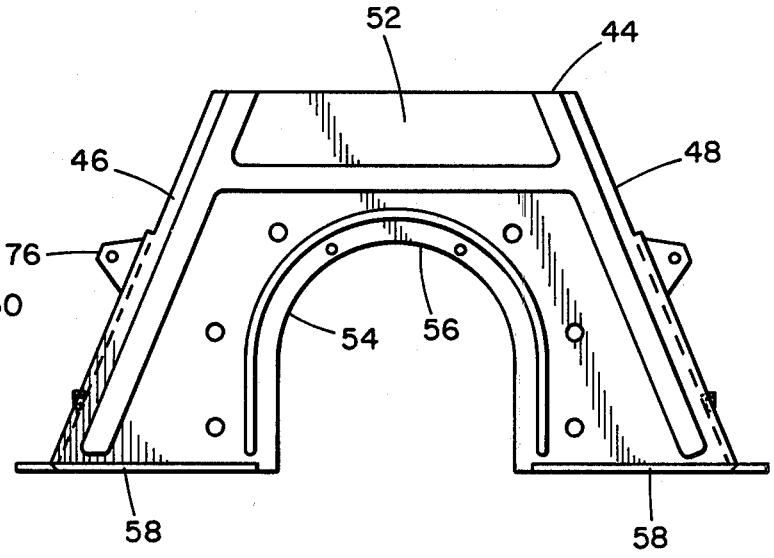
FIG. 4 is an elevational view of the base portion of the guard housing shown in FIG. 2.
Figure 5:
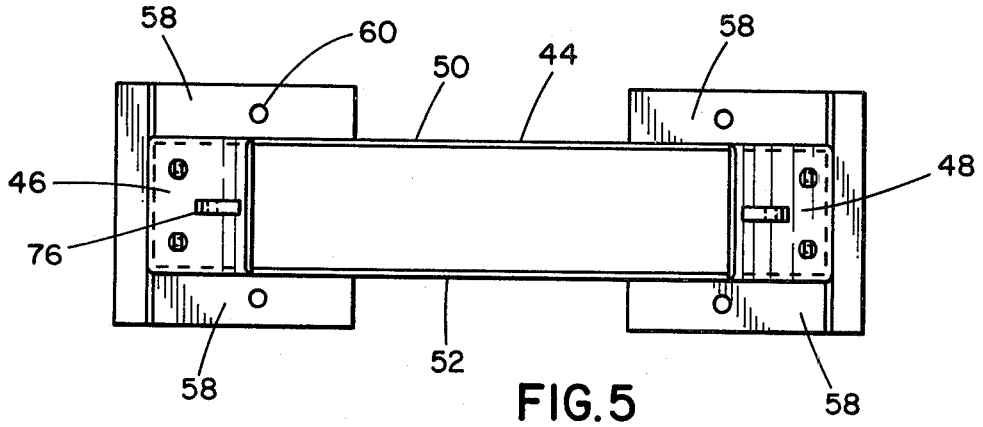
FIG. 5 is a top plan view of the base portion shown in FIG. 4.

The base portion, shown in detail in FIGS. 4 and 5, comprises a housing 44 of trapezoidal shape, with the major dimension in the direction perpendicular to the axis of the wheel and which is formed of inclined end walls 46 and 48 and vertically disposed front and back side walls 50 and 52. The end walls 46 and 48 are dimensioned to have a length to extend above the wheel axis and are spaced one from the other to enclose the wheel therebetween. The front and back side walls 50 and 52 are spaced one from the other in parallel relation by an amount slightly greater than the width of the wheel. The front and back side walls 50 and 52 are each formed with crosswise aligned openings 54 which extend upwardly from the bottom edge and terminate in a substantially semi-circular upper edge portion 56 of slightly larger diameter than the central opening in the wheel plates 10 and 12 and at a level for crosswise alignment therewith to enable the feed spout 24 and the hub 25 to extend therethrough to the wheel. Horizontally disposed flanges 58 extend outwardly from the lower edges of the front and back side wall portions and from the lower edge of the end wall portions to rest on the top surface of the supporting base 30 and to which they are secured by bolts extending through openings 60 in the flange portions to secure the lower base portion of the housing to the base plate.

Figure 6:
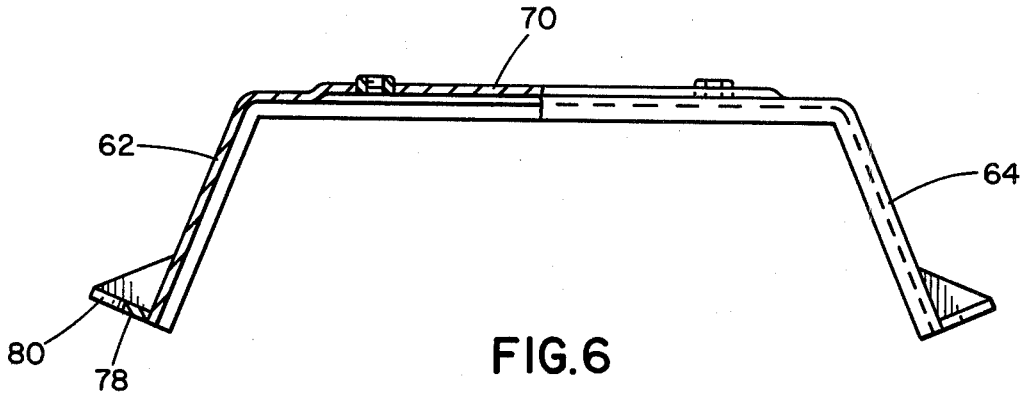
FIG. 6 is a sectional elevational view of the cover portion of the guard housing.
Figure 7:
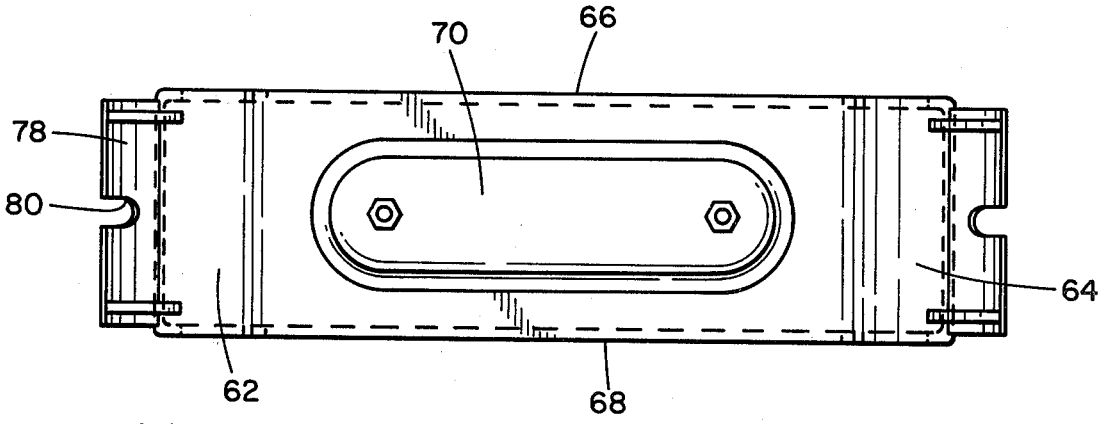
FIG. 7 is a top plan view of the cover portion shown in FIG. 6.

The cover portion C, shown in detail in FIGS. 6 and 7, is also cast or formed of steel, in the form of a trapezoidal section adapted to fit onto the base section B as a continuation thereof, with the end walls 62 and 64 having the same inclination as the end walls 46 and 48 of the base section, and spaced at their lower ends by an amount corresponding to the spaced relation at the upper edges of the corresponding walls of the base section so as to extend as a continuation thereof. The front and back side walls 66 and 68 have the same spaced relation as the front and back side walls 50 and 52 of the base section and are dimensioned to extend vertically as a continuation thereof to define an enclosure therebetween including a top wall 70 extending over the upper edges of the front and back side walls and end walls of the cover portion with the top wall 70 being disposed at a level above the wheel thereby to enclose the wheel within the guard housing.

Means are provided releasably to secure the cover portion C onto the base portion B as well as hingedly to connect the cover portion to the base portion to enable the cover portion to be rocked about a pivot at either end to a raised position. For this purpose, a clevis bolt 72 is pivotally secured at one end into a hinged pin 74 extending from an offset portion of a bracket 76 secured to extend outwardly from the upper outer surface of each of the end wall portions 46 and 48 of the base member, adjacent their upper ends. The corresponding walls 62 and 64 of the cover portion are provided with a flanged portion 78 which extends outwardly from the lower edge with a slot 80 extending inwardly from the outer edge dimensioned to have a width corresponding to the width of the clevis bolt 72 to enable the bolt to be displaced into and out of the slot. The clevis bolt 72 is dimensioned to have a length greater than the distance between the pivot pin 74 and the flange 78 so that the body portion of the bolt will extend through the slot 80 when rocked to latching position. The through extending portion of the clevis bolt is provided with a nut 82 which, when tightened onto the through extending portion of the clevis bolt, holds the cover down tightly onto the base section. When loosened, the through extending portion of the clevis bolt 72 can be rocked about its pivot for displacement from the slot, thereby to release the cover portion C for rocking movement about the pivot pin on the opposite wall. When both of the clevis bolts are released from their corresponding slots, the cover portion C can be lifted from the base portion to expose the interior for replacement or repair of the parts and to inspect the wheel.

Clevis bolts 72 can also be used as a hinge by providing one or both of the bolts 72 with a jamming nut 73, shown to the right in FIG. 2, with the jamming nut 73 threadably engaged on the threaded portion of the clevis bolt immediately below the flanged portion 80 to enable the jamming nut to be tightened to grip the flanged portion 80 between the nut 82 and jamming nut 73. In this manner, the cover portion C can be lifted about the pivot and rotated endwise from either end of the housing.

The lining is designed from a number of parts adapted to be assembled in an interfitting relation alongside the interior walls of the guard housing with portions attached thereto for support. The lining is fabricated as by casting of a strong, wear resistant metal, such as marketed by Wheelabrator-Frye Inc. under the trade name LONG LYFE. Other strong, wear resistant metals can be used as interior lining for the guard housing to receive the brunt of the wear and errosion from the abrasive particles flying about within the housing. The various parts of which the lining is assembled are shown in detail in FIGS. 8 to 16.

Figure 8:
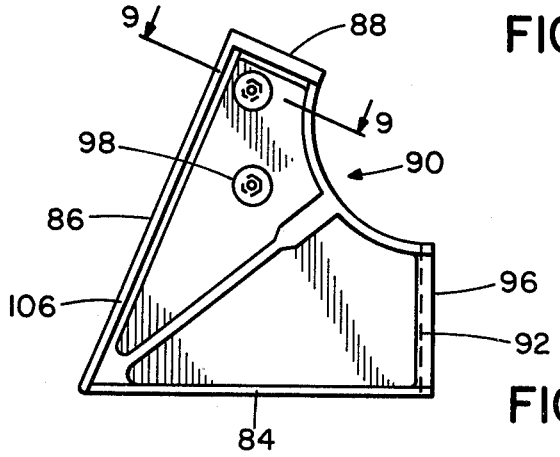
FIG. 8 is an elevational view of the lower side liner of the lining shown in FIG. 2.
Figure 9:
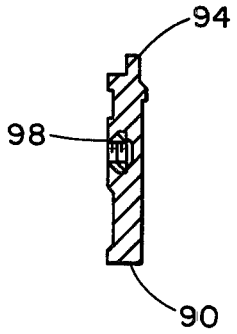
FIG. 9 is a top end view of the lower side liner of FIG. 8 taken along line 9—9.
Figure 10:
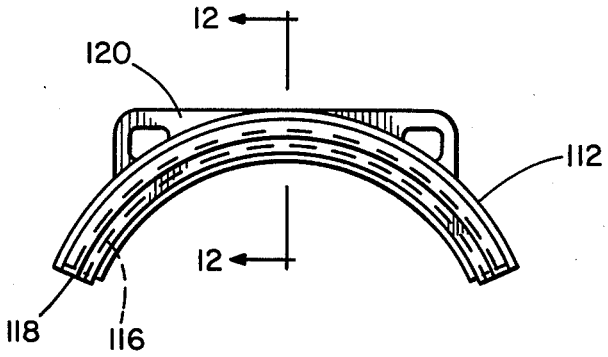
FIG. 10 is an elevational view of the top liner shown in FIG. 2.
Figure 11:
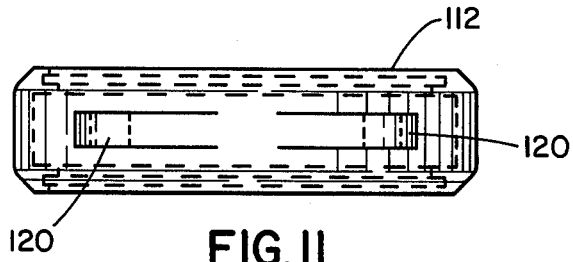
FIG. 11 is a top plan view of the top liner of FIG. 10.
Figure 12:
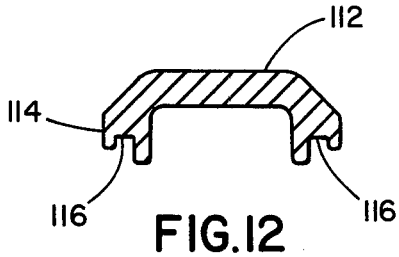
FIG. 12 is a sectional view taken along line 12—12 of FIG. 10.
Figure 13:
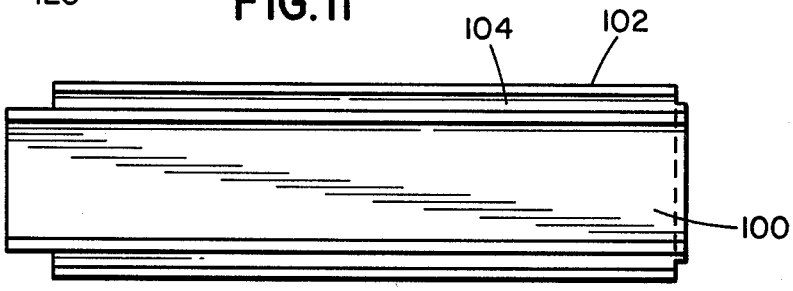
FIG. 13 is an elevational view of the lower end liner.
Figure 15:
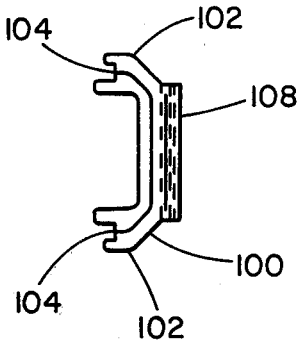
FIG. 15 is an end view of the end liner of FIG. 13.
Figure 14:
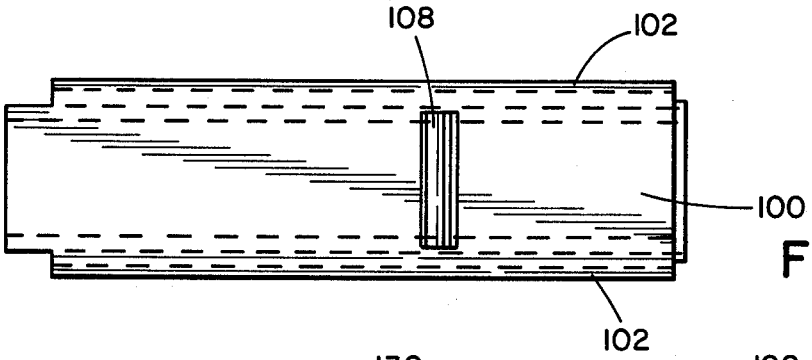
FIG. 14 is a top plan view of the end liner of FIG. 13.

FIGS. 8 and 9 show lower front or back side wall sections on the lining. There are four such lining sections of the same design and construction except that two are left hand sections and the other two are right hand sections, with front and back side walls, each being formed of a right hand and left hand section.

Each section is in the form of a relatively flat member dimensioned to have a length to extend from below the base 30 through the opening 32 in the base to a level slightly above the axis 42 of the wheel and a width which diminishes from the bottom edge to the top edge to extend inwardly to about a vertical line through the axis of the wheel. The lower front and back side wall sections which extend below the base also extend outwardly beyond the opening so that in effect each section is defined by an elongate horizontally disposed bottom wall 84 dimensioned to have a length greater than the distance between the vertical center line of the wheel to the edge of the opening 32 and an outer edge 86 which makes an acute angle with the bottom edge 84 and is shaped to correspond with the slope of the adjacent end wall 46 of the guard housing. The upper edge 88 of the lower front or back side wall sections slopes downwardly from the outer end which is slightly above the axis of the wheel and merges into a concave corner portion 90 of a circular section having a diameter corresponding somewhat to the opening in the wall of the guard housing and in crosswise alignment therewith. The circular section 90 terminates in an inner edge 92 which extends vertically downwardly to the horizontally disposed lower edge 84 along about the vertical line through the axis of the wheel.

The upper edge 88 is formed with a tongue 94 along one side to interfit with a groove in a section of the lining to fit therein and the inner edge 92 is also formed with a tongue 96 to interfit with an opposite groove in the inner edge of the other of the pair of bottom sections making up the front and back side walls while the outer edge 86 is formed with a groove to interfit with a tongue extending from the lateral edges of the end wall panels hereinafter to be described.

Fastening nut members 98 are imbedded in the body portion of each lower side wall section for engagement by bolt members extending through aligned openings in the side walls of the guard housing releasably to secure the lining sections onto the inner face of the front and back side walls of the guard housing.

The ends are closed by end liners 100 in the form of a pair of elongate rectangular members having a width corresponding to the spaced relation between the pairs of lower side wall sections and a length slightly greater than the length of the outer edges of the lower side wall sections to extend from a short distance below the lower side wall sections to a level in endwise alignment with the upper edge 88 of the lower side wall portions. The lateral edges 102 of the end liners 100 are turned through an angle of about 90° and are formed with a groove 104 extending continuously through the face thereof for receiving the tongue 106 extending from the outer edges of the lower side wall sections in interfitting relation.

The end liners 100 which are slideable lengthwise on the outer edges of the lower side wall sections are each retained in their assembled relation by means of a stop 105 in the form of a bolt member which extends through an opening in the end wall of the guard housing with means for turning the bolt to project into and out of the path of an abutment 108 extending outwardly crosswise to the end liner 100 intermediate its ends. In response to turning movement of the bolt 105 in threaded engagement with a nut member 110 fixed to the guard housing, the end of the bolt can be projected into the path of the abutment 108 to hold the end liner in the desired assembled relation, or the bolt can be turned to withdraw the end portion from the path of the abutment to enable the end liner section to be lowered for removal, replacement or repair.

Extending crosswise between the upper edges of the end liner sections 100, from the upper edge at one side to the upper edge of the other side, is a top liner 112 (FIGS. 10 11 and 12), in the form of a cylindrical section dimensioned to have a width corresponding to the distance between the upper front and back side wall sections and a length corresponding to the distance between the upper edges of the end wall sections 100. The lateral portions 114 of the top liner section are turned through an angle of about 90° with grooves 116 extending continuously through the inner face thereof for receiving in interfitting relation tongues which extend outwardly from upper front and back side wall sections hereinafter to be described.

The ends of the top lining section are provided with tongues 118 to interfit with the tongue and grooved arrangement provided in the upper edge of the end wall liners 100.

The top side of the top liner section is formed with a pair of holed lands 120 underlying the cover C of the guard housing in position to be engaged by set screws 122 extending downwardly from the guard housing when the cover is secured in position of use. The length of the portion of the set screws extending downwardly from the cover can be adjusted by lock nuts 124 so as firmly to engage the top wall of the top liner section to hold the latter down in operative engagement with the side and end wall sections when the cover is closed, thereby to insure a tight interfitting relation between the parts.

When the wheel and housing are mounted in a substantially vertical or nearly inverted position, it is desirable to provide means for holding the top curved liner in position when the housing cover is opened. For this purpose, use is made of a pair of retainer pins 123 which extend through apertures in the front and back plate faces of the guard housing base section and through lifting apertures 125 in the top liner section 112. The retainer pins 123 are held in place by fastening means such as cotter pins, snap rings, or nut and bolt means to prevent inadvertent endwise displacement. The retainer pins can be removed one at a time for safe removal of the top liner 112.

The lining assembly is completed by a pair of top front and back side liner sections 126 in the form of flat plates having an outer diameter corresponding to the curvature of the top liner section and an inner diameter corresponding to the concave portion 90 of the lower side wall sections. The liner plates 126 extend crosswise between the upper edges 88 of the adjacent pairs of lower side wall sections to complete the central circular opening for access through the lining to the central portion of the wheel. The upper edge 128 of the top side section 126 is formed with a tongue 130 for receipt in the groove 116 of the top liner section 112 while the end faces 132 are formed with tongues that extend into grooves formed in the upper edges 88 of the lower side wall sections.

Each of the upper side liners 126 are provided with nut members 134 imbedded therein for threaded engagement by bolt members operable through aligned openings in the side walls of the guard housing for securing the top side sections 126 to the housing in the assembled relation.

In assembly, the guard housing base portion B is bolted onto the base plate. The lower side plates and the upper side plates are bolted to the guard housing. The end liners 100 are slid over the edges of the lower side wall sections until engaged by the stop 105 and then the top liner 112 is merely set onto the assembled members to complete the lining enclosure. The bolt members 122 are adjusted to bear on the upper section of the top liner to hold the latter down in its assembled relation when the cover is secured in position of use by the clevis bolts 72 to cause the assembled relation.

Figure 16:
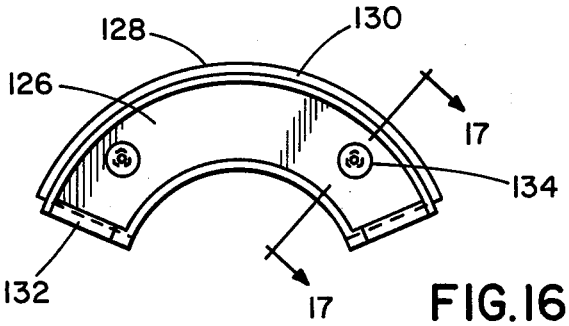
FIG. 16 is an elevational view of the top side liner section of the lining shown in FIG. 2.
Figure 17:
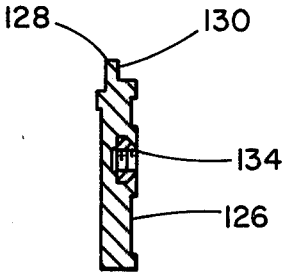
FIG. 17 is a sectional view taken along the line 17—17 of FIG. 16.
Figure 18:
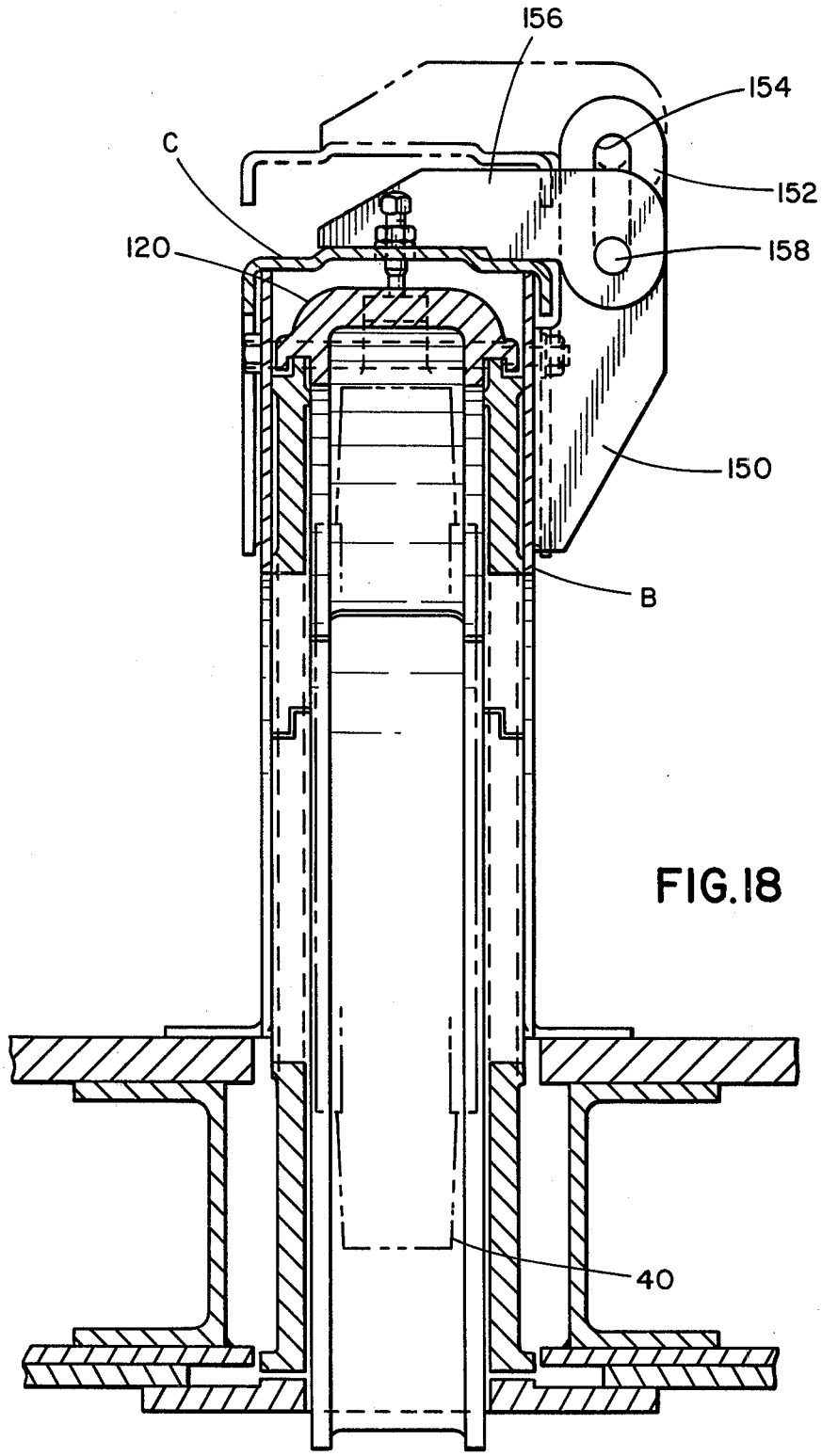
FIG. 18 is a sectional elevational view of a modification in the pivotal support for the top cover of the guard housing.
Figure 19:
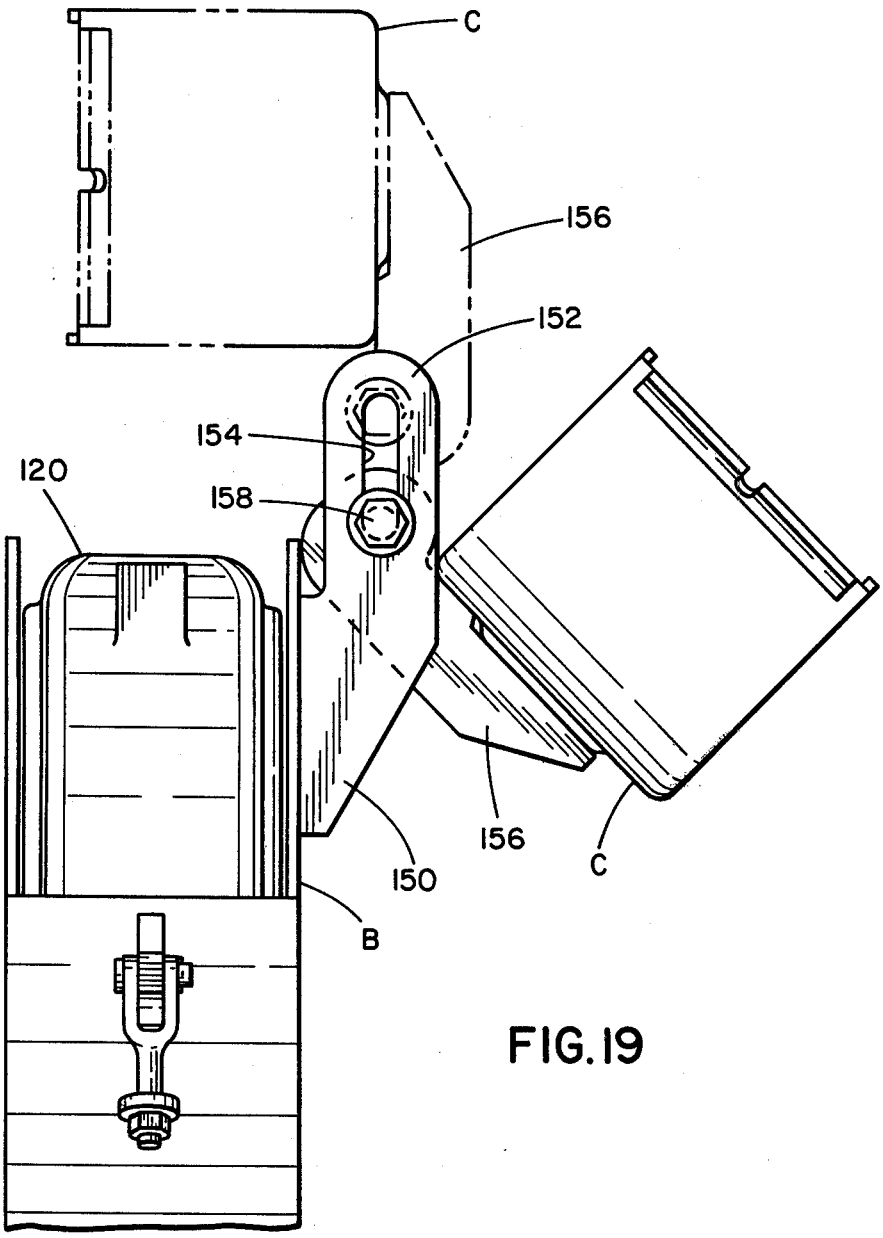
FIG. 19 is a side elevational view of the modification shown in FIG. 18, illustrating the pivotal movement of the top cover.

By way of modification shown in 16, the housing cover section can be hingedly mounted onto the base portion B in a manner to enable rotation to an open position toward the rear of the base section. As illustrated in FIG. 16, a pair of bracket plates 150 are fixed to longitudinally spaced apart portions of the upper end portion of the base section, with each plate having an extension 152 extending upwardly beyond the top of the housing with an elongate vertically disposed slot 154 therein. Extending laterally from the cover are a pair of hinge plates 156 having hinge pins 158 engaged within the slots 154.

The pin and slot arrangement enables the cover to be released as heretofore described and then raised by the amount limited by the slot 154 to clear the lining so that the cover can thereafter be rocked about the pins to open position.

It will be understood that changes may be made in the details of construction, arrangement and operation without departing from the spirit of the invention, espcially as defined in the following claims.

We claim:

1. A guard housing and lining for a bladed wheel whereby particulate material is thrown by centrifugal force from the ends of the blades onto a surface below the wheel including a base on which the wheel is mounted with an opening through the base in alignment with the blades of the wheel for projection of particulate material therethrough onto the surface to be treated, said wheel being supported for rotational movement on a hub extending axially into engagement with one side of the wheel and means for feeding particulate material from a feed spout communicating with an axial opening at the other side of the wheel, said guard housing and lining comprising a trapezoidal section open at the bottom and at the top with a larger opening at the bottom in which the trapezoidal section is formed of vertically disposed front and back walls and inclined end walls spaced one from the other by an amount greater than the respective width and length of the bladed wheel, means mounting the trapezoidal section of the housing onto the base with the open botton in registry with the opening through the base plate, a cover having laterally spaced apart front and back side walls and inclined end walls spaced one from the other by an amount corresponding to the spaced relation of the side and end walls of the trapezoidal section at their right ends so that the cover fits onto the open top of the trapezoidal section, and a top wall enclosing the upper end of the cover, a pivotal connection between at least one of the end walls of the cover and the corresponding end wall of the trapezoidal section to enable the cover to be rocked between open and closed positions and including means for disengagement of the pivotal connection to enable removal of the cover from the trapezoidal section, and plates of lining material supported by the guard housing for lining the interior surface thereof, in which the lining is formed of sections consisting of a lower side wall lining formed of a pair of lower side wall sections for each side wall and means for securing the lower side wall sections to the adjacent side wall of the trapezoidal section of the guard housing, a pair of end wall sections spanning the space between the ends of the side wall sections and means for blocking movement of the end wall sections from their assembled relation, a top section which spans the space between the upper ends of the end wall sections, and an upper side wall section for each side wall filling the space between the upper edges of the lower side wall sections and the top section, and means operatively engaging the top wall section to hold down the top wall section when the cover is in closed position.

2. A guard housing and lining as claimed in claim 1 in which the pivotal connection between the cover and trapezoidal section comprises a clevis bolt pivotally connected to one of the members including the end wall of the trapezoidal section and cover, and a flanged portion extending outwardly from the end wall of the other, a slot extending inwardly from the edge of the flanged portion in alignment with the clevis bolt to enable the clevis bolt to be rocked about its pivot into and out of the slot, and means operatively engaging the through extending end portion of the clevis bolt for releasably securing the clevis bolt in the slot.

3. A guard housing and lining as claimed in claim 2 in which the clevis bolt is dimensioned to have a length greater than the distance between its pivot and the flanged portion, screw threads on the end portion of the clevis bolt and a nut member adapted threadably to engage the through extending end portion of the clevis bolt.

4. A guard housing and lining as claimed in claim 1 which includes openings through each of the side walls of the guard housing and cover to define an opening therebetween in axial alignment with the bladed wheel for passage of the wheel hub and feed spout therethrough.

5. A guard housing and lining as claimed in claim 1 in which the lining is formed of a plurality of sections which interfit one with another to cover the interior walls of the guard housing.

6. A guard housing and lining as claimed in claim 1 in which the interfitting relation between the end sections and the outermost ends of the lower side wall sections of the lining comprise flanged portions extending substantially perpendicularly inwardly from the lateral edges of the end sections, a groove in the end face of the flanged portions, and a tongue extending outwardly from the outermost edges of the lower side wall sections dimensioned to be received in an interfitting relation in the grooves.

7. A guard housing and lining as claimed in claim 1 in which the means for blocking movement of the end wall sections from their assembled relation comprises abutments which extend outwardly from the outer surfaces of the end wall sections and a bolt member which extends inwardly from the adjacent end wall of the trapezoidal section of the guard housing mounted for movement into and out of the path of the abutment.

8. A guard housing and lining as claimed in claim 1 in which the means for holding down the top section of the lining comprises at least one bolt member extending through the top wall of the cover into engagement with the top surface of the top liner when the cover is in closed position.

9. A guard housing and lining as claimed in claim 1 in which the inner corner portions of the lower side wall sections and the upper side wall sections are formed with curvilinear openings which, when in the assembled relation, define a circular opening therebetween in axial alignment with the opening through the guard housing for extension of the wheel hub and feed spout therethrough.

10. A guard housing and lining as claimed in claim 1 in which the interfitted relation between the sections of the lining is formed by the adjacent edges of the adjacent sections having a groove in one and interfitting with a tongue extending outwardly from the other.

11. A guard housing and lining as claimed in claim 1 which includes means for attachment of the upper side wall sections to the adjacent side walls of the cover.

12. A guard housing as claimed in claim 1 in which the pivotal connection between the cover and the trapezoidal section is a bracket plate fixed to the upper end portion of the housing in which the bracket has a portion extending upwardly beyond the top of the housing, an elongate vertically disposed slot in said extension, and hinge plates extending laterally from the cover having a hinge pin engaged within the slot to enable vertical and pivotal movement of the cover relative to the housing.

* * * * *